United States Patent [19]

Brown

[11] Patent Number: 4,892,121

[45] Date of Patent: Jan. 9, 1990

[54] BLADDER TYPE SHUTTLE BRAKING APPARATUS FOR LOOMS

[75] Inventor: Charles M. Brown, Starkville, Miss.

[73] Assignee: Niagara Lockport Industries Inc., Quincy, Fla.

[21] Appl. No.: 219,090

[22] Filed: Jul. 14, 1988

[51] Int. Cl.[4] ..... D03D 49/54

[52] U.S. Cl. ..... 139/185; 188/151 R

[58] Field of Search ..... 139/185, 183, 186, 187; 188/151 R

[56] References Cited

U.S. PATENT DOCUMENTS

| | | | |
|---|---|---|---|
| 2,042,119 | 5/1936 | Northrop | 139/186 |
| 2,234,597 | 3/1941 | Holmes | 139/185 |
| 2,417,295 | 3/1947 | Darwin | 139/185 |
| 2,843,157 | 7/1958 | Schwabe | 139/185 |
| 3,227,188 | 1/1966 | Baker et al. | 139/185 |
| 3,395,737 | 8/1968 | Wueger | 139/185 |
| 3,403,708 | 10/1968 | Sundquist . | |
| 3,865,150 | 2/1975 | Demuth . | |
| 4,169,492 | 10/1979 | Grady . | |
| 4,374,552 | 2/1983 | Dayen | 188/72.9 |
| 4,669,512 | 6/1987 | Hintsch . | |
| 4,674,544 | 6/1987 | Hintsch . | |

FOREIGN PATENT DOCUMENTS

| | | | |
|---|---|---|---|
| 1130376 | 10/1968 | United Kingdom | 139/187 |

*Primary Examiner*—Andrew M. Falik

*Attorney, Agent, or Firm*—Pettis & McDonald

[57] ABSTRACT

A braking assembly for use on loom shuttle boxes is provided extending inwardly of at least one wall of the shuttle cell and includes a support member attachable to the shuttle cell wall, a shuttle engaging member having at least one surface for engaging a shuttle entering the cell and at least one inflatable bladder interposed between the support member and the shuttle engaging member for urging the shuttle engaging member inwardly of the cell upon inflation of the bladder into a position interfering with movement of the shuttle within the cell. The assembly further includes apparatus for urging the bladder to a deflated condition to move the shuttle engaging member away from engagement of the shuttle when the bladder is deflated.

9 Claims, 2 Drawing Sheets

BLADDER TYPE SHUTTLE BRAKING APPARATUS FOR LOOMS

BACKGROUND OF THE INVENTION

This invention relates generally to improvement in shuttle boxes for looms. More particularly, it relates to improvements in braking apparatus for stopping the movement of a shuttle received into a cell of such a shuttle box.

Looms for commercial weaving conventionally employ at least one shuttle box at each end of a shuttle raceway across which the shuttle is propelled at high velocity during the weaving process. Upon completion of the travel of the shuttle across the raceway, from one shuttle box to the opposite shuttle box, it is necessary to stop the travel of the shuttle within the receiving shuttle box. While movement of the shuttle must be stopped within a very short distance upon entering the shuttle box, it is important to stop movement of the shuttle smoothly to avoid damage to the shuttle and to avoid disturbing the filament winding on the bobbin within the shuttle. Accordingly, it is known to incorporate frictional material, such as leather, on a deflectable member that forms a part of one wall of a shuttle cell. This member mounted is on a toggle linkage as in Sundquist, Jr., U.S. Pat. No. 3,403,708 or provides for actuation or linkages by pneumatic or hydraulic cylinders as in Grady, U.S. Pat. No. 4,169,492. While these braking mechanisms have worked with greater or lesser degrees of satisfaction, none has provided the desired degree of positive yet smooth braking that has been sought.

SUMMARY OF THE INVENTION

In consideration of the difficulties encountered with prior art shuttle boxes and braking mechanisms, it is an object of the present invention to provide a shuttle box possessing an improved braking mechanism. It is another object of the invention to provide such a mechanism that accomplishes positive yet smooth braking of a shuttle entering the shuttle box.

To achieve these and other objects that will become apparent to those skilled in the art, a shuttle braking apparatus is provided for use in a shuttle box cell on a loom in which a shuttle is picked along a shuttle raceway between two opposing shuttle boxes and in which the shuttle cells have a plurality of walls extending generally parallel to the shuttle raceway, with the cell being aligned with the raceway for receiving a shuttle moving along the raceway. This braking apparatus has at least a portion thereof extending inwardly of at least one cell wall and includes a support member joined to the cell wall, a shuttle engaging member having at least one surface for engaging a shuttle entering the cell, at least one inflatable bladder structure operatively connected to the shuttle engaging member for urging the shuttle engaging member inwardly of the cell upon inflation of the bladder such that inflation of the bladder structure will urge the shuttle engaging member toward a position interfering with movement of a shuttle within the cell to brake movement of the shuttle, and structure for urging the bladder to a deflated condition to move the shuttle engaging member away from engagement with the shuttle within the cell when the bladder is deflated.

DESCRIPTION OF THE DRAWINGS

Two particularly preferred embodiments of the shuttle box assembly of the present invention, and particularly its improved braking mechanism, will be described in detail below in connection with the drawings in which.

DESCRIPTION OF PREFERRED EMBODIMENTS

Figure 1:
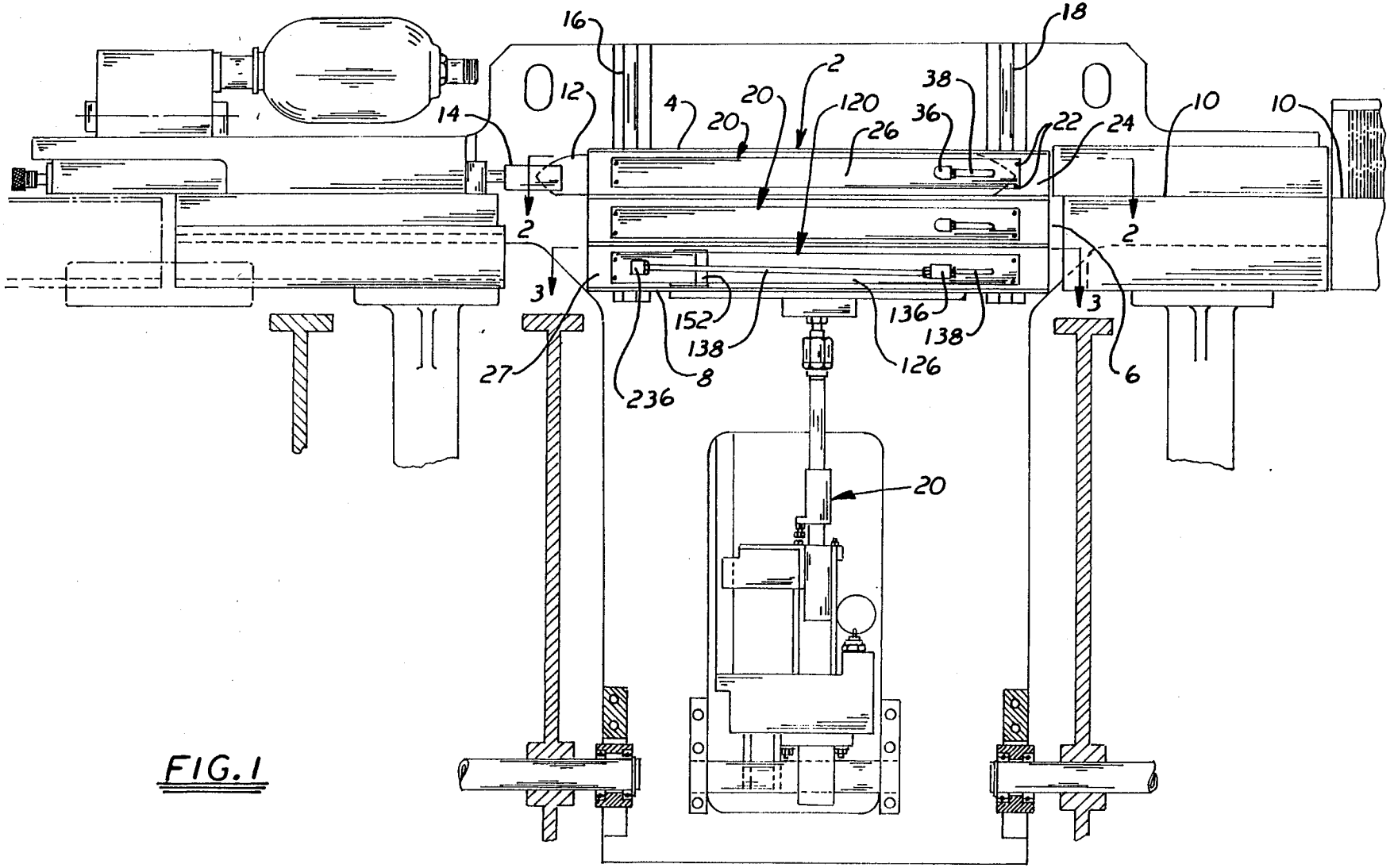
FIG. 1 is a side view of a portion of one end of a loom illustrating a shuttle box assembly in accordance with the present invention.

FIG. 1 illustrates a shuttle box assembly according to the present invention installed on a commercial weaving loom. While this improved shuttle box assembly may easily be installed on any conventional type of commercial loom, it is illustrated, solely for convenience, as installed on a loom according my co-pending application entitled Ser. No. 214,209 filed July 1, 1988, "Loom With Selectively Positionable Shuttle Mechanism."

This shuttle box assembly, generally indicated by reference numeral 2, comprises a shuttle cell, or in this case a plurality of shuttle cells 4, 6 and 8 formed by a plurality of walls extending generally parallel to shuttle raceway 10. In FIG. 1 cell 4 is aligned with the raceway 10 for receiving a conventional shuttle 12 that moves along the raceway 10. In FIG. 1, the shuttle 12 is shown engaging the nose piece 14 of the picking mechanism that is used to launch the shuttle back along the raceway 10, from left to right in FIG. 1. The shuttle cells 4, 6 and 8 conveniently in this embodiment are joined together to form a three cell unit and are supported by guides 16 and 18 for movement to bring a selected such cell into alignment with the raceway 10. A conventional shuttle box actuating unit 20, such as a fluid operated cylinder, may serve to move the selected one of the shuttle box cells 4, 6 and 8 into the desired alignment with the raceway 10. All of this mechanism may be mounted for pivoting movement with the raceway during the beating up step of weaving on the loom.

Each of the shuttle cells 4 and 6 includes a shuttle braking apparatus 20, and cell 8 includes a braking apparatus 120. Each such binder 20 or 120 conveniently is affixed to a wall of the shuttle cell by conventional fasteners 22. In the enlarged section view of FIG. 2 one such binder 20 is illustrated affixed to one wall 24 of shuttle cell 4. This illustration may be considered typical of the relationship between the binder 20 and each of the shuttle cells 4 and 6.

Figure 2:
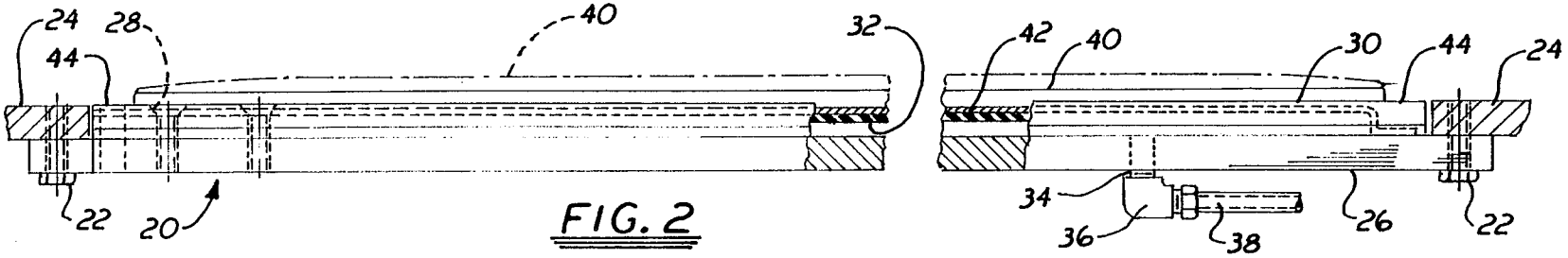
FIG. 2 is a sectional view at an enlarged scale, taken along line 2—2 of FIG. 1 and showing the braking mechanism forming a portion of the shuttle box assembly of FIG. 1.

While it would be easily possible to mount this entire shuttle braking apparatus 20 inside the shuttle cell 4, it is mounted in the manner illustrated, with a portion extending through the wall 24 of cell 4 for ease of access, assembly and maintenance. This shuttle braking apparatus 20 includes a support member 26 attachable to the cell wall 24, conveniently by cap screws 22 or other convenient fastening means, as illustrated in FIG. 2. This backing member 26 conveniently is formed of steel or other rigid material and has affixed to it by other fasteners 28, shown in phantom in FIG. 2, a clamping member 30 which suitably is also fabricated of steel or other rigid material. Interposed between backing member 26 and clamping member 30 is a membrane 32, preferably formed of an elastomeric material. Preferably, only the peripheral edges of the membrane 32 are engaged between clamping member 30 and backing member 26, with the center portion of that membrane free to move and to expand under the influence of pressurized fluid introduced between the membrane 32 and backing member 26.

As shown in FIG. 2, a suitable fluid conduit may take the form of threaded nipple 34 onto which is received coupling 36 joining the nipple 34 with tubing 38 that may lead to a conventionally controlled source of fluid, whether gaseous or liquid, that may selectively be pressurized or released, as desired. The threaded nipple 34 in this embodiment extends through the backing member 36 and is in communication with the space between the surface of backing member 26 and the surface of membrane 32. By the clamping arrangement of the membrane 32, that membrane thus forms a bladder that may be inflated and deflated by introduction or release of pressurized fluid through the tubing 38, coupling 36 and nipple 34. The solid line representation in FIG. 2 illustrates the bladder formed by membrane 32 in its deflated configuration, with the broken line representation illustrating the results of introduction of pressurized fluid between the membrane 32 and backing member 26. For reasons to be described in more detail below, a friction member 40, which may suitably be leather or other tough material, is mounted, as by adhesive bonding, over the surface of membrane 32 that faces inwardly of the shuttle box cell (upwardly in FIG. 2). The solid line representation of FIG. 2 illustrates the position of this friction member 40 when the bladder formed by membrane 32 is in its deflated position. The broken line representation of FIG. 2 illustrates the extended position of the friction member 40 when the bladder formed by membrane 32 is inflated, urging the friction member 40 in a direction inwardly of the shuttle cell for engaging a shuttle received therewithin.

To provide additional support for the friction member 40 and to serve as one convenient means to urge the bladder 32 to a deflated condition, an additional member 42 formed of spring steel or a functionally equivalent resiliently deflectable material preferably is interposed between the membrane 32 and the friction member 40. This flexible member 42 permits the desired deflection of the friction member 40 under the urging of the inflated bladder or membrane 32 but provides additional strength to absorb the energy of an incoming shuttle to be braked. The ends of the member 42 may be clamped to the backing member 26 in any convenient manner, such as by threaded fastener extending through a clamping block 44, through the member 42 and into the backing member 26.

Figure 5:
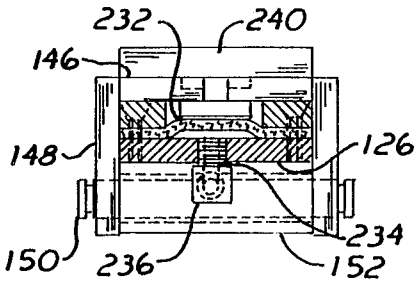
FIG. 5 is a sectional view taken along line 5—5 of the braking mechanism of FIG. 3.
Figure 4:
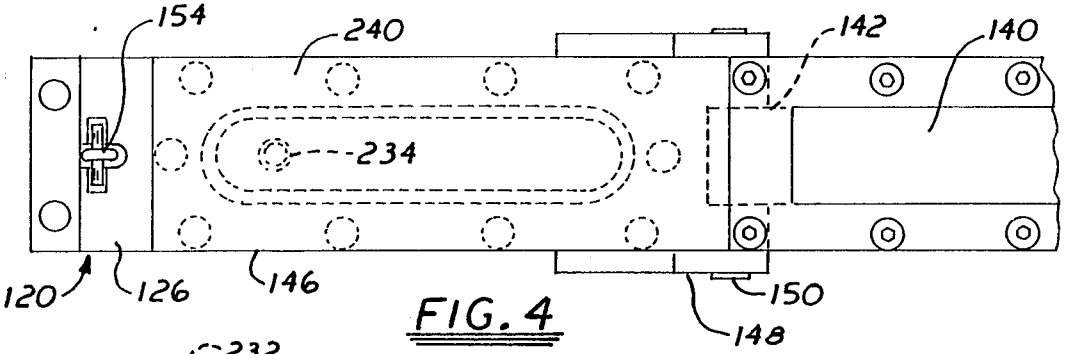
FIG. 4 is a fragmentary top view of the braking mechanism of FIG. 3.
Figure 3:
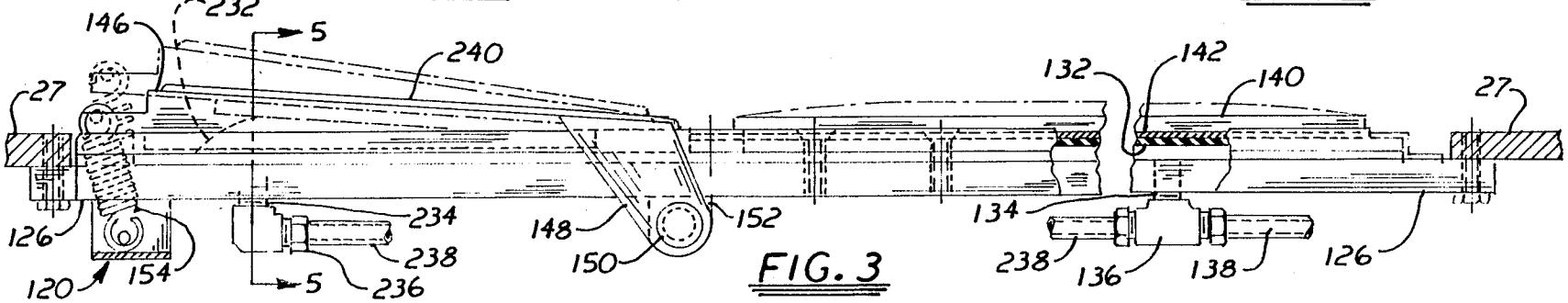
FIG. 3 is a sectional view, at an enlarged scale, taken along line 3—3 of FIG. 1 and showing an alternative embodiment of the braking mechanism forming a portion of the shuttle box assembly of FIG. 1.

A second and even more preferred embodiment of the apparatus of this invention is illustrated in FIGS. 3 through 5. This second embodiment essentially incorporates the bladder and friction member structure of the embodiment of FIG. 2 and adds to it a pivoting member for engaging a portion of the nose of a shuttle. For the sake of simplicity, those portions of this second embodiment that correspond to the first are referenced by the same reference numbers increased by 100, e.g. the backing member of this second embodiment in FIG. 3 carries reference number 126 in comparison to reference number 26 on FIG. 2. To the extent the components are substantially similar, they are not described again in detail.

It may be noted that the friction member 140 and its underlying and actuating bladder or membrane first portion 132 are foreshortened from the corresponding structures of FIG. 2. This is to provide room for the elongated pivoting member 146. This elongated pivoting member 146 is mounted to backing member 126 for pivotal movement as indicated by the broken line representation. More specifically, in this particular embodiment, the pivoting member 146 includes adjacent a first and thereof pivot portions 148 through which extend a pivot shaft 150 that may conveniently be journaled into a support bracket 152 affixed to the backing member 126.

Underlying the pivoting member 146 is a membrane second portion forming a bladder second portion 232, one side of which is in communication with a selectively applicable source of pressurized fluid through nipple 234, fitting 236 at conduit 238, which conveniently may extend from fitting 136 that underlies the membrane 132. The membrane second portion 232 and membrane first portion 132 may, as a matter of choice, either be two portions of one unitary membrane or, if desired, may be two separate membranes, this being a matter of design choice. When pressurized fluid is applied through the nipple 234 to the underside (in FIG. 3) of the membrane second portion 232, the edges of which membrane are sealingly engaged with the backing member 126, that pressurized fluid effects inflation of the elastomeric membrane or bladder, generally as illustrated in the broken line representation in FIG. 3. This effects pivoting of the member 146 about the axis of shaft 150 to the position indicated by the broken line representation. This extends the second end of the elongated pivoting member 146 and the friction member 240, which may suitably be leather, into the path of a incoming shuttle, in a manner to be described below. A resilient biasing member, such as tension spring 154, may have one end connected to the second end of member 146 distal the pivot bracket 148 at the first end thereof to urge the member 146 back to the retracted position illustrated by the solid line representation of FIG. 3 when fluid pressure is removed from beneath the membrane 232.

With the structure of the braking apparatus, this invention having been described in detail above, the manner of operation of the apparatus may now be understood. As shown on FIG. 1, the braking assembly 20 may be mounted to the side of a shuttle cell 4 of a shuttle box assembly. The side wall 24 of the shuttle cell 4 to which the braking assembly 20 is mounted would normally have an aperture cut through that wall 24 conveniently to receive all portions of the braking assembly except backing member 26, generally in the manner illustrated in FIG. 2. The braking assembly 20 conveniently may be affixed to the shuttle cell wall 24 by fasteners 22. With this mounting, when a shuttle, such as shuttle 12, is about to be received by that shuttle cell 4, pressurized fluid, either gaseous or liquid, is introduced from a conventional controlled source through conduit 38 into the space behind the bladder member 32. This serves to inflate the bladder 32, urging it away from backing member 26 and likewise urging the shuttle engaging portions, including the flexible support 42 and the frictional portion 40 inwardly of the shuttle cell, generally somewhat in the manner illustrated in the broken line representation of FIG. 2. Thus, as the shuttle 12 enters the shuttle cell 4, the extended friction member 40 creates an interference with the shuttle so that the frictional engagement between that member 40 and the side of the shuttle will brake movement of the shuttle, so that the shuttle stops without undue impact. This structure thus provides for a relatively smooth deceleration of the shuttle entering the shuttle cell. Once the shuttle has been received fully within the cell and stopped, the fluid pressure in conduit 38 is released so that the natural resilience of the shuttle engaging portions will return it to the retracted position shown in the solid line representation of FIG. 2 out of braking engagement with the shuttle.

Installation of the second preferred embodiment 120 of this apparatus is shown with respect to the shuttle cell 8. Installation of this second embodiment is substantially the same as with the first. Likewise, when that shuttle cell 8 is aligned with the raceway 10, operation of this second embodiment is substantially similar to that of the first. As the shuttle approaches the shuttle cell 8, pressurized fluid from a conventionally controlled source is introduced through conduit 138 and fitting 136 into the area behind the bladder membrane first portion 132. At the same time this pressurized fluid is carried by conduit 238 through fitting 236 into the area behind the second portion 232 of the bladder structure, so that both portions 132 and 232 of the bladder structure are inflated. Inflation of the first bladder portion 132 effects extension of the shuttle engaging structure 140 and 142 to provide for frictional engagement between the friction member 140 and the side of the shuttle. At the same time, inflation of the second bladder portion 232 effects pivoting of the rigid elongated member 146 to the position indicated by the broken line representation of FIG. 3 to further and more positively engage the tapered nose portion of the conventional shuttle with the friction material 240 overlying that member 146. Thus, this second embodiment has the advantage of a more positive engagement with the tapered portions of the shuttle as well as with the straight side portions of the shuttle. This provides for a more positive braking action once the tapered nose portion of the shuttle engages the friction material 240 overlying the elongated member 146.

It is to be understood that either the embodiment 20 of FIG. 2 or the embodiment 120 of FIGS. 3 through 5 may be utilized with any or all of the shuttle cells. The combination illustrated in FIG. 1 of two units of the first embodiment of FIG. 2 and one unit of the embodiment of FIGS. 3 through 5 is solely for the purpose of illustration. It is also to be understood that a plurality of such braking devices could be applied to one shuttle cell. For example, one braking apparatus could be mounted to each side of the shuttle cell, if desired, to increase the braking action. Likewise, this braking apparatus may be applied on numerous other types of shuttle box assemblies having one or a plurality a shuttle cells and, for those having a plurality of shuttle cells, may be applied to those that are shifted in position linearly or in a rotary manner as in my co-pending patent application. The installation illustrated herein is to be considered only as typical and illustrative of one convenient manner of application.

While the foregoing illustrates and describes in detail two particularly preferred embodiments of the apparatus of this invention, it is to be understood that this description is illustrative only of the principles of the invention and is not to be considered limitative thereof. Accordingly, because numerous variations and modifications of this apparatus, all within the scope of the invention, will readily occur to those skilled in the art. The scope of the invention is to be limited solely by the claims appended hereto.

What is claimed is:

1. A shuttle braking apparatus for use in a shuttle box cell on a weaving loom having a selectively controllable source of pressurized fluid and in which a shuttle is picked along a shuttle raceway between two opposing shuttle box cells and in which the shuttle cells have a plurality of walls extending generally parallel to the shuttle raceway with the shuttle cell being aligned with the raceway for receiving a shuttle moving along the raceway, said braking apparatus having at least a portion thereof extending inwardly of at least one cell wall and comprising a support member joined to said cell wall;

a shuttle engaging member having at least one surface for engaging a shuttle entering said cell;

at least one selectively inflatable and deflatable bladder interposed between said support member and said shuttle engaging member for urging said shuttle engaging member inwardly of said cell upon inflation of said bladder by selective introduction of pressurized fluid thereinto, such that inflation of said bladder will urge said shuttle engaging member toward a position interfering with movement of a shuttle within said cell, whereby inflation of the bladder will serve to brake movement of a shuttle within the cell; and means for urging said bladder to a deflated condition upon selective release of said pressurized fluid therefrom to move said shuttle engaging member away from engagement with a shuttle within said cell when said bladder is deflated.

2. The shuttle box braking apparatus of claim 1 wherein said inwardly extending portion extends inwardly of a side wall of said cell for engaging a lateral side of a shuttle entering said cell.

3. The shuttle box braking apparatus of claim 1 wherein said shuttle engaging member comprises a substantially rigid elongated member having a first end thereof pivotally mounted to said support member such that inflation of a portion of said bladder will urge said member to pivot about said pivotal mount to swing the second end of said member distal said first end inwardly of said cell for engaging a shuttle received within said cell.

4. The shuttle box braking apparatus of claim 3 wherein said bladder urging means includes resilient biasing means for urging said shuttle engaging member second end toward a position outwardly of the interior of said cell, whereby room for an incoming shuttle is provided within said cell when the bladder portion is deflated.

5. The shuttle of claim 1 wherein said bladder comprises a plurality of inflatable bladder portions.

6. The shuttle braking apparatus of claim 5 wherein said shuttle engaging member comprises a deflectable friction member overlying at least a first portion of the surface of said bladder proximal a shuttle received by said shuttle box, whereby the shuttle engaging member is interposed between the bladder first portion and any shuttle received within the shuttle box.

7. The shuttle braking apparatus of claim 6 further comprising said deflectable friction member overlying said first portion of said bladder; and said shuttle engaging member further comprising a substantially rigid elongated member having a first end thereof pivotally mounted to said shuttle cell and said elongated member being operatively connected to said second portion of said bladder, such that inflation of said bladder will urge said resiliently deflectable member inwardly of said shuttle cell and will urge said elongated member to pivot about said pivotal mount to swing the second end of said elongated member distal said first end inwardly of said cell for engaging a shuttle received within said cell.

8. The shuttle braking apparatus of claim 7 wherein said bladder urging means includes resilient biasing means for urging said elongated member second end outwardly of said cell.

9. The shuttle box assembly of claim 1 wherein said shuttle engaging member comprises a friction member portion for frictionally engaging said shuttle.

* * * * *